US009045305B2

(12) United States Patent
Hattori

(10) Patent No.: US 9,045,305 B2
(45) Date of Patent: Jun. 2, 2015

(54) IMAGE FORMING SYSTEM AND SHEET CONVEYANCE METHOD

(75) Inventor: Hitoshi Hattori, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 233 days.

(21) Appl. No.: 13/561,533

(22) Filed: Jul. 30, 2012

(65) Prior Publication Data

US 2013/0032990 A1 Feb. 7, 2013

(30) Foreign Application Priority Data

Aug. 1, 2011 (JP) ..... 2011-168590

(51) Int. Cl.

| | |
|---|---|
| ***B65H 31/00*** | (2006.01) |
| ***B65H 29/12*** | (2006.01) |
| ***B65H 29/14*** | (2006.01) |
| ***B65H 31/30*** | (2006.01) |
| ***B65H 39/10*** | (2006.01) |
| ***G03G 15/00*** | (2006.01) |

(52) U.S. Cl.

CPC ..... *B65H 29/125* (2013.01); *B65H 2301/4213* (2013.01); *B65H 2301/4452* (2013.01); *B65H 2404/166* (2013.01); *B65H 2801/27* (2013.01); *B65H 29/145* (2013.01); *B65H 31/3027* (2013.01); *B65H 39/10* (2013.01); *B65H 2511/10* (2013.01); *B65H 2511/22* (2013.01); *B65H 2511/415* (2013.01); *B65H 2513/50* (2013.01); *B65H 2701/18263* (2013.01); *G03G 15/6552* (2013.01); *G03G 15/6573* (2013.01)

(58) Field of Classification Search

CPC .... B65H 2801/06; B65H 31/02; B65H 31/26; B65H 9/101; B65H 2801/42; B65H 2801/27; B65H 31/34; B65H 37/04; B65H 29/68; B65H 33/12; B65H 33/14; B65H 2301/30; B65H 2301/35; B65H 2301/351; B65H 7/00; B65H 29/00; B65H 43/00; B65H 43/08; B65H 2513/50; B65H 2513/40; B42C 1/12; B76H 2511/222

USPC ..... 271/207, 220, 241; 270/58.11, 58.12, 270/58.08, 58.17

See application file for complete search history.

(56) References Cited

U.S. PATENT DOCUMENTS 6,315,288 B1 * 11/2001 Sugishima et al. ..... 271/303
7,717,422 B2 * 5/2010 Matsumoto et al. ..... 271/270

(Continued)

FOREIGN PATENT DOCUMENTS

JP 2005-031382 2/2005
JP 2007-106594 4/2007

*Primary Examiner* — Thomas Morrison
(74) *Attorney, Agent, or Firm* — Harness, Dickey & Pierce, P.L.C.

(57) ABSTRACT

An n image forming system includes an image forming apparatus, a sheet processing apparatus including a post-processing unit to perform post-processing of sheets on a processing tray and a retaining channel disposed to accommodate at least a single sheet while the post-processing unit processes the sheets, and a controller that calculates a target interval time between an interval start sheet and an interval end sheet among the sheets output from the image forming apparatus to the sheet processing apparatus based on at least one of sheet data and post-processing data transmitted from the image forming apparatus to the sheet processing apparatus, and adjusts an interval between discharge of the interval start sheet and the interval end sheet from the image forming apparatus to the sheet processing apparatus in accordance with the target interval time.

14 Claims, 9 Drawing Sheets

(56) References Cited

U.S. PATENT DOCUMENTS

| | | | | |
|---|---|---|---|---|
| 8,038,138 | B2 * | 10/2011 | Iguchi | 270/58.11 |
| 8,292,285 | B2 * | 10/2012 | Yokoya et al. | 270/58.31 |
| 2007/0040328 | A1 | 2/2007 | Hattori | |
| 2009/0137374 | A1 | 5/2009 | Kobayashi et al. | |
| 2010/0207314 | A1 | 8/2010 | Hattori et al. | |
| 2011/0076081 | A1 | 3/2011 | Hattori et al. | |
| 2011/0148024 | A1 * | 6/2011 | Iguchi | 270/58.09 |
| 2011/0285072 | A1 * | 11/2011 | Yokoya et al. | 270/58.07 |
| 2011/0301005 | A1 | 12/2011 | Hattori et al. | |

* cited by examiner

IMAGE FORMING SYSTEM AND SHEET CONVEYANCE METHOD

CROSS-REFERENCE TO RELATED APPLICATION

This patent application is based on and claims priority pursuant to 35 U.S.C. §119 to Japanese Patent Application No. 2011-168590, filed on Aug. 1, 2011, in the Japan Patent Office, the entire disclosure of which is hereby incorporated by reference herein.

FIELD OF THE INVENTION

The present invention generally relates to an image forming system that includes an image forming apparatus, such as a copier, a facsimile machine, a printer, or a multifunction machine capable of at least two of these functions, to form images on sheets of recording media and a sheet processing apparatus to perform predetermined post-processing of the sheets on which images have been formed, and a sheet conveyance method used therein.

BACKGROUND OF THE INVENTION

At present, post-processing of sheets that requires a relatively long processing time typically involves stacking multiple sheets one on top of another before the sheets are conveyed to a post-processing means so that multiple sheets can be conveyed at a time, thus minimizing productivity loss.

For example, a preliminary stacking channel in which multiple sheets are retained may be provided upstream from the post-processing means, such as an alignment tray, in a direction in which the sheets are transported (sheet conveyance direction). When the number of sheets stacked preliminary in the preliminary stacking channel reaches five, a subsequent sheet (i.e., sixth sheet) and the five sheets stacked preliminary are discharged to the alignment tray at a time. This conveyance method can save time compared with a case in which the sheets are conveyed singly, one at a time. Accordingly, productivity loss can be minimized, particularly in processing operations such as stapling at multiple positions, which requires a relatively long time.

The image forming apparatus may transmit sheet data and post-processing type to the sheet processing apparatus including the preliminary stacking channel, and time required for post-processing calculated based on the transmitted data is reported to the image forming apparatus. Then, an interval between two consecutive sheets discharged from the image forming apparatus to the sheet processing apparatus is adjusted according to the reported processing time. In this method, loss in productivity caused by post-processing of sheets can be reduced, and, if the processing type is changed, such changes can be reflected properly.

In configurations in which multiple sheets are retained in the preliminary stacking channel, it is preferable to variably control the length of the discharge intervals between sheets. Specifically, although a single sheet interval between two consecutive sheets is typically increased to secure post-processing time, when multiple sheets are stacked preliminary, discharge intervals of sheets discharged from the image forming apparatus for optimum productivity depends on the number of sheets stacked preliminary.

Accordingly, it is necessary to change the discharge intervals according to the number of sheets stacked preliminary. However, such control is complicated, increasing both the time necessary for development as well as the number of software bugs. Overcomplicated control of sheet conveyance can be avoided by increasing the length of the discharge intervals, but at the cost of a decrease in productivity.

BRIEF SUMMARY OF THE INVENTION

In view of the foregoing, one embodiment of the present invention provides an image forming system that includes an image forming apparatus to form images on sheets of recording media, a sheet processing apparatus, and a controller to control discharge intervals of multiple sheets output from the image forming apparatus to the sheet processing apparatus. The sheet processing apparatus includes a post-processing unit to perform a predetermined post-processing of the sheets output from the image forming apparatus on a processing tray, and a retaining channel disposed upstream from the processing tray in a sheet conveyance direction to accommodate at least a single sheet while the post-processing unit processes the sheets. The controller calculates a target interval time between two sheets, but the latter is not necessarily immediately subsequent to the former, output from the image forming apparatus based on at least one of sheet data and post-processing data transmitted from the image forming apparatus to the sheet processing apparatus. The two sheets are designated as an interval start sheet and an interval end sheet. The controller adjusts an interval between discharge of the interval start sheet and the interval end sheet from the image forming apparatus to the sheet processing apparatus in accordance with the target interval time.

Another embodiment provides a sheet conveyance method used in the above-described image forming system. The sheet conveyance method includes a step of transmitting sheet data and post-processing data from the image forming apparatus to the sheet processing apparatus, a step of calculating a target interval time between an interval start sheet and an interval end sheet output from the image forming apparatus to the sheet processing apparatus based on at least one of the sheet data and the post-processing data, and a step of adjusting an interval between discharge of the interval start sheet and the interval end sheet from the image forming apparatus to the sheet processing apparatus in accordance with the calculated target interval time.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
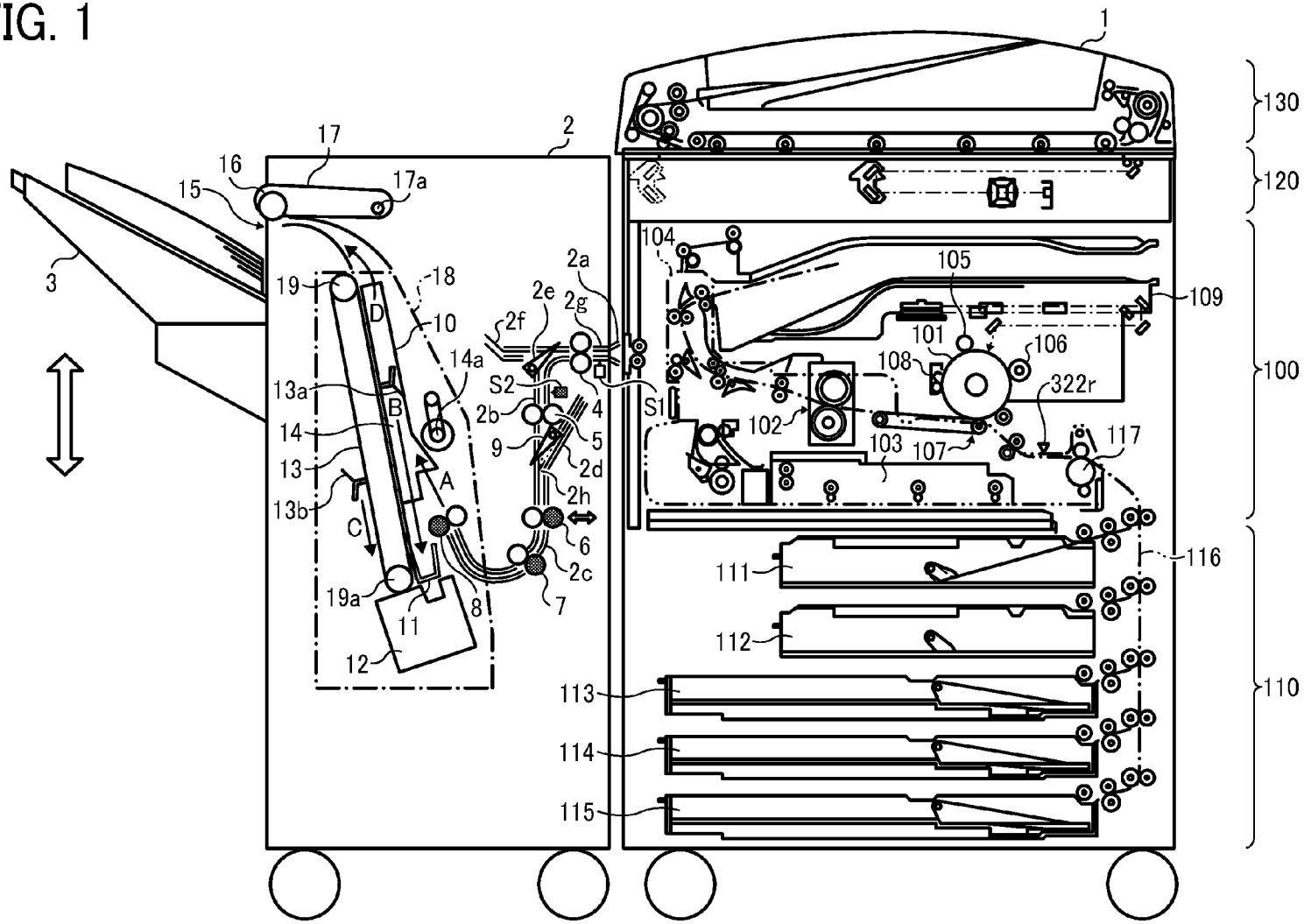
FIG. 1 illustrates a configuration of an image forming system including a sheet processing apparatus and an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming system including a sheet processing apparatus and an image forming apparatus according to an embodiment of the present invention is described.

It is to be noted that the terms "upstream" and "downstream" used in this specification means those in a direction in which sheets of recording media are transported in the image forming system (hereinafter "sheet conveyance direction) according to embodiments of the present invention unless otherwise specified. Additionally, that recording media include paper, transfer sheets, overhead projector (OHP) films, and the like.

Referring to FIG. 1, the image forming system according to the present embodiment includes a image forming apparatus 1 to form images on sheets of recording media and a sheet processing apparatus 2 to perform post-processing, such as aligning, sorting, stapling, and/or punching, of sheets discharged from the image forming apparatus 1. The image forming apparatus 1 can be a copier, a facsimile machine, a printer, or multifunction machine capable of forming images on sheets. In the configuration shown in FIG. 1, the image forming apparatus 1 is a copier.

The image forming apparatus 1 shown in FIG. 1 includes an apparatus body 100, a sheet feeder 110, a reading unit 120, and an automatic document feeder (ADF) 130. The apparatus body 100 is disposed above the sheet feeder 110, and the reading unit 120 is disposed above the apparatus body 100. The ADF 130 is provided above the reading unit 120.

The image forming apparatus 1 according to the present embodiment employs an electrophotographic method, and the apparatus body 100 contains a photoreceptor 101, a fixing device 102, a duplex unit 103, and a sheet discharge unit 104. Around the photoreceptor 101, a charging device 105, a development device 106, a transfer unit 107, a cleaning unit 108, and a discharger are provided. The apparatus body 100 further includes a writing unit 109. The writing unit 109 includes an optical device such as a laser diode (LD) and a driver integrated circuit (IC) to drive the optical device (for flashing operation) according to data to perform optical writing on the photoreceptor 101.

The sheet feeder 110 includes sheet trays 111, 112, 113, 114, and 115 for containing sheets of recording media. Sheets are fed from a designated sheet tray and conveyed through a vertical conveyance path 116 to the transfer unit 107 via a pair of registration rollers 117. The writing unit 109 optically writes an electrostatic latent image on the photoreceptor 101, and the development device 106 develops the latent image into a toner image, which is transferred onto the sheet by the transfer unit 107. Then, the fixing device 102 fixes the image on the sheet.

The reading unit 120 optically reads image data of an original placed on an exposure glass while moving in a sub-scanning direction or reads image data of an original transported by the ADF 130 with a movable carriage kept motionless. Generally, the former is called flatbed reading, and the latter is called sheet-through reading. For example, originals that are bound together into a book is read in flatbed reading, whereas multiple separate sheets are read sequentially in sheet-through reading. In the present embodiment, the ADF 130 is a circulation-type ADF called an automatic reversing document feeder (ARDF) and capable of reversing originals.

The sheet processing apparatus 2 includes a sheet inlet 2*a*, lower paths 2*b* and 2*c*, an upper path 2*f*, a preliminary stacking channel 2*d*, a processing unit 18, a discharge roller 16, a discharge port 15, and a discharge tray 3. The sheet inlet 2*a* is an opening for receiving sheets discharged from the image forming apparatus 1. An entry detector S1 and a pair of entrance rollers 4 are provided to a conveyance path 2*g* leading from the sheet inlet 2*a*.

Downstream from the pair of entrance rollers 4 in the sheet conveyance direction, the conveyance path 2*g* bifurcates into the lower paths 2*b* and 2*c* leading to the processing unit 18 and the upper path 2*f* leading to the discharge port 15 at a bifurcation where a bifurcation pawl 2*e* is provided. The lower path 2*b* (hereinafter also "first lower path 2*b*") is upstream from a bifurcation 2*h* where a switching pawl 9 is provided, and the lower path 2*c* (hereinafter also "second lower path 2*c*" is downstream from the bifurcation 2*h*). The bifurcation pawl 2*e* is driven by a stepping motor to switch a sheet conveyance route.

A sheet detector S2 and first conveyance rollers 5 are provided on the upstream side of the first lower path 2*b* in the sheet conveyance direction, and the downstream end of the first lower path 2*b* is connected to the preliminary stacking channel 2*d* at such an angle that the preliminary stacking channel 2*d* can receive sheets being transported in reverse to the sheet conveyance direction. The switching pawl 9 is provided at the bifurcation therebetween to function as a guide for reverse conveyance of the sheet. The second lower path 2*c* extends from the bifurcation 2*h* to the processing unit 18. Second and third rollers 6 and 7 are provided to the second lower path 2*c*, extreme downstream of which is provided with a pair of discharge rollers 8.

The processing unit 18 includes a stapling tray 14 on which sheets are stacked, an aligning fence 10, a trailing-end fence 11, an alignment roller 14*a* to push the sheets to the trailing-end fence 11, a stapler 12 to staple the sheets on the stapling tray 14 after alignment, and a release mechanism to release a bundle of stapled sheets from the stapling tray 14. The aligning fence 10 aligns the sheets on the stapling tray 14 in the direction perpendicular to the sheet conveyance direction, and the trailing-end fence 11 aligns the sheets in the sheet conveyance direction. The release mechanism includes a release belt 13 and a pair of projections 13*a* and 13*b*. The release belt 13 is stretched around a release roller 19 and a driven roller 19*a* and designed to discharge the sheets through the discharge port 15 to the discharge tray 3 using the projection 13*a* or 13*b*. At that time, the sheets are discharged while pushing up the discharge roller 16, which is provided to a free end of a discharge lever 17 rotatably supported by a support shaft 17*a*. Accordingly, the sheets receive a predetermined degree of pressure from the discharge roller 16 and can be transported reliably.

Similarly to known sheet processing apparatuses, the sheet processing apparatus 2 can further have capability of punching, folding and the like in addition to alignment and stapling.

Figure 2:
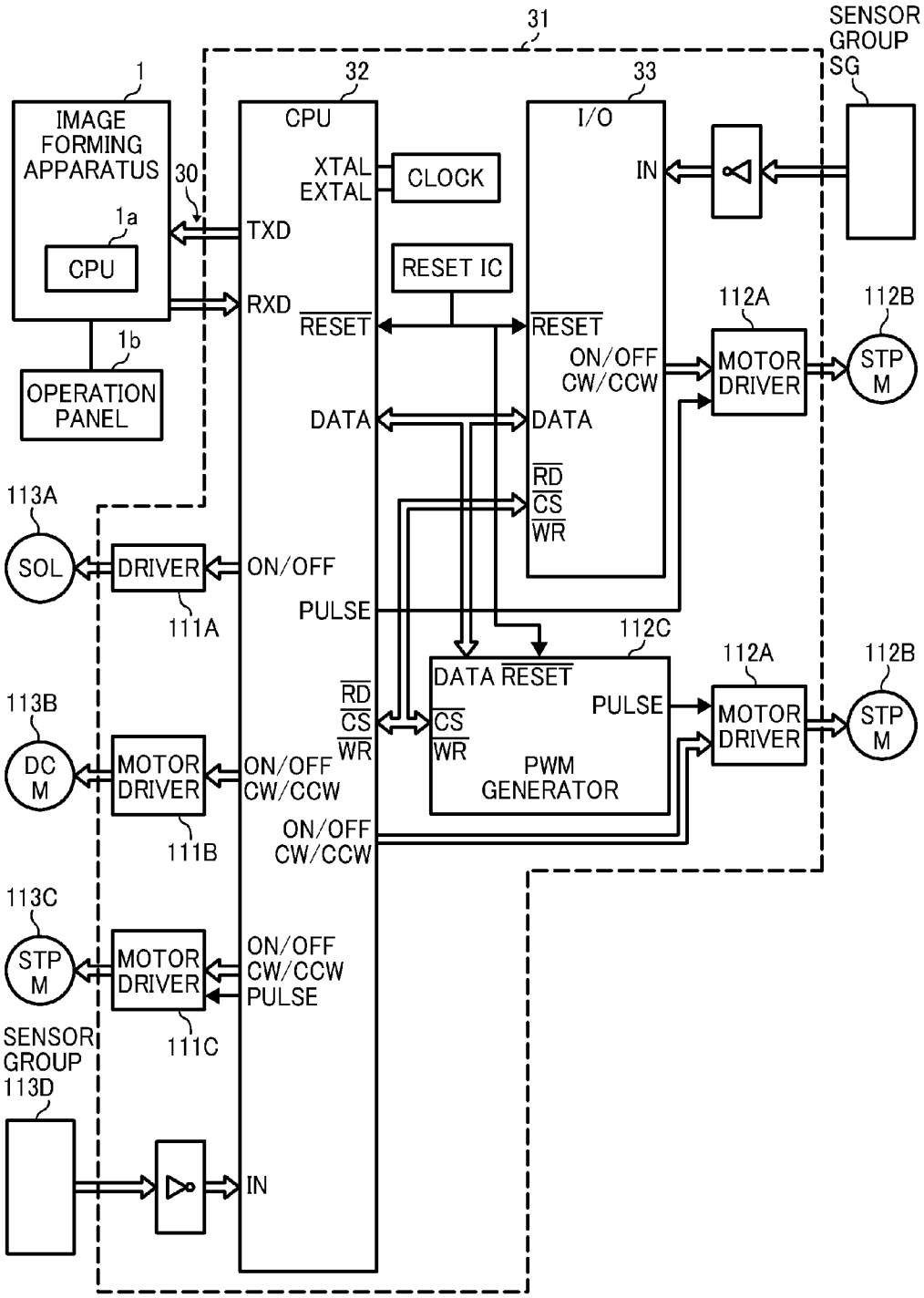
FIG. 2 is a block diagram illustrating a configuration of a control circuit of the image forming system according to an embodiment.

FIG. 2 is a block diagram illustrating a configuration of a control circuit of the image forming system according to the present embodiment. In the control circuit, a controller 31 of the sheet processing apparatus 2 includes a micro computer including a central processing unit (CPU) 32 and an input/output (I/O) interface 33. Signals from sensor groups SG and 113D including the entry detector S1 and the sheet detector S2 are input to the CPU 32 via the I/O interface 33. According to the input signals, the CPU 32 controls various motors, such as motor drivers 111A, 111B, 111C, and 112A to drive stepping motors 112B and 113C, a direct current (DC) motor 113B, stepping motors 112B and 113C, solenoids 113A, and the like,. The CPU 32 also controls motors for driving and moving the stapler 12, and the stapler 12 staples the sheets at predetermined positions instructed by the CPU 32.

The CPU 32 reads out program codes stored in a read only memory (ROM) and performs various types of control based on the programs defined by the program codes using a random access memory (RAM) as a work area and data buffer. The data necessary for control or processing can be stored in erasable programmable read-only memory (EPROM) in addition to the RAM. Alternatively, the control circuit may be configured so that a CPU 1*a* of the image forming apparatus 1 controls the operation of the sheet processing apparatus 2. In such a case, the CPU 32 of the sheet processing apparatus 2 can communicate with the CPU 1*a* via a communication interface 30. Additionally, the image forming apparatus 1 includes a control panel 1*b* as a user interface via which users input instructions to the image forming apparatus 1 and the sheet processing apparatus 2. The control panel 1*b* can display a state of the image forming apparatus 1 and the sheet processing apparatus 2 and various types of information.

It is to be noted that, in an ordinal state, the CPU 1*a* of the image forming apparatus 1 functions as a main controller, and the CPU 32 of the sheet processing apparatus 2 functions as a sub-controller.

Additionally, similarly to the CPU 32, the CPU 1*a* reads out program codes stored in a ROM and performs various types of control based on the programs defined by the program codes using a RAM as a work area and data buffer.

The control circuit further includes a pulse width module (PWM) generator 112C.

Sheet conveyance in a case in which only one set of sheets is processed is described below. The sheet discharged from the image forming apparatus 1 enters the sheet processing apparatus 2 from the sheet inlet 2*a*. Then, the sheet is detected by the entry detector S1 and conveyed by the entrance rollers 4 through the conveyance path 2*g*. The CPU 32 instructs the direction in which the bifurcation pawl 2*e* guides the sheet according to instructions regarding sheet processing transmitted from the CPU 1*a* of the image forming apparatus 1. To transport the sheet toward the processing unit 18, the bifurcation pawl 2*e* is rotated counterclockwise to the position shown in FIG. 1, and the sheet is guided to the first lower path 2*b*. Then, with the conveyance force applied from the entrance rollers 4 and the conveyance rollers 5 to the sheet guided to the first lower path 2*b*, the switching pawl 9 is rotated counterclockwise in FIG. 1, thus securing a space through which the sheet moves. The sheet is guided to the second lower path 2*c* and transported further by the second and third rollers 6 and 7 downstream, after which the sheet is discharged by the discharge rollers 8 to the stapling tray 14.

The sheet is disengaged from the nip between the discharge rollers 8 and slides down the stapling tray 14 as indicated by arrow B shown in FIG. 1 under its own weight. Simultaneously, the alignment roller 14*a* pushes the sheet down, and the trailing-end fence 11 aligns the trailing end of the sheet in the sheet conveyance direction. The trailing end of the sheet can be detected preliminary by the sheet detector S2, and, after elapse of a time period necessary for alignment of the trailing end of the sheet, the aligning fence 10 aligns the sheet in the width direction. When only one set of sheets is processed, multiple sheets are thus aligned one at a time by repeating this operation.

Next, sheet conveyance in a case in which multiple sets of sheets are processed is described below.

In the processing unit shown in FIG. 1, a subsequent set of sheets cannot be discharged onto the stapling tray 14 unless the preceding set of sheets is removed from the stapling tray 14. Therefore, to reduce loss in processing time in processing of multiple sets of sheets, the sheet processing apparatus 2 performs preliminary stacking operation.

Intervals between sheets output from the image forming apparatus 1 are constant, and intervals between jobs are constant. When a first set (initial set) of sheets is output, the image forming apparatus 1 transmits signals indicating sheet size, the number of sheets, conveyance velocity, processing type, and the like to the sheet processing apparatus 2. When the sheet processing apparatus 2 receives those signals, the CPU 32 determines the number of sheets stacked preliminary in the preliminary stacking channel 2*d*, the point where the conveyance velocity is increased, a target linear velocity up to which the conveyance velocity is increased, the point where the sheet is reversed, the point where the sheet is stopped for stacking, and the like. It is to be noted that the term "job" used in this specification means a unit of work performed by the image forming apparatus 1, for example, work necessary for copying a set of sheets.

FIGS. 3A through 3D illustrate preliminary stacking operation using the preliminary stacking channel 2*d*. In the state shown in FIG. 3A, a first sheet P1 of a given job output from the image forming apparatus 1 has passed by the switching pawl 9 and is at a distance a from the bifurcation 2*h*. The bifurcation 2*h* can be approximated to a position where a leading end of the switching pawl 9 is positioned. At that time, if the sheet P1 is transported in reverse according to a signal from the image forming apparatus 1, the second and third conveyance rollers 6 and 7 are stopped and then rotate in reverse (clockwise in FIG. 3A). Then, the switching pawl 9 guides the sheet to the preliminary stacking channel 2*d*. An elastic force of relatively small pressure is constantly applied to the switching pawl 9 so that the switching pawl 9 pushed by the sheet can pivot to secure a space sufficient for the sheet to pass through. Thus, the preliminary stacking channel 2*d* can be opened.

Figure 3A:
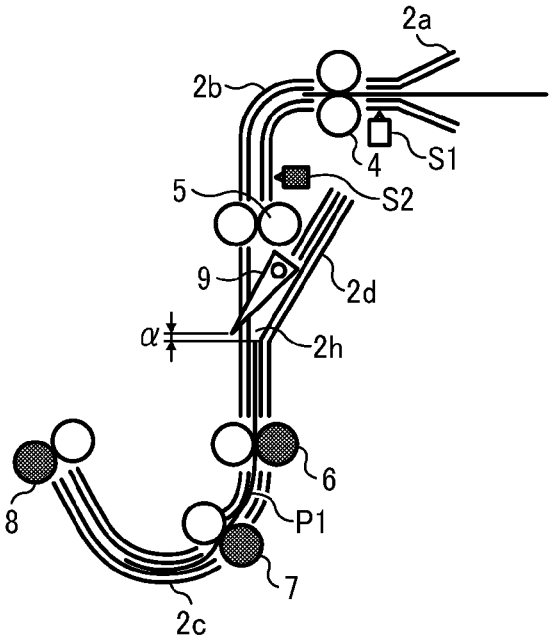
FIGS. 3A through 3D illustrate preliminary stacking operation using a preliminary stacking channel.
Figure 3B:
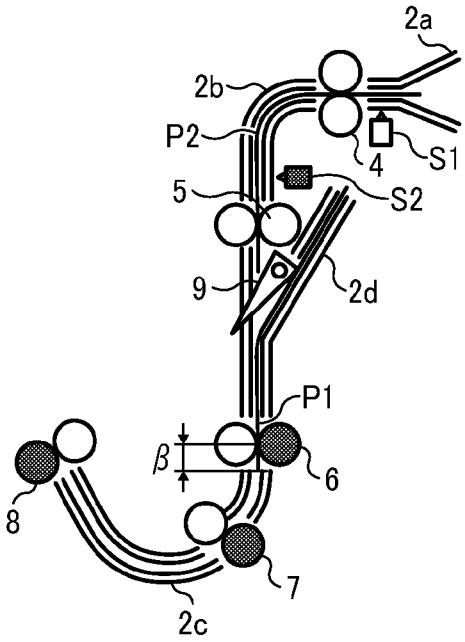

The distance by which the sheet is transported to the preliminary stacking channel 2*d* can be measured based on pulse counts of the sheet detector S2 immediately upstream from the conveyance rollers 5 in the sheet conveyance direction or timers, and conveyance of the sheets transported to the preliminary stacking channel 2*d* is controlled so that the trailing end (leading end in reverse conveyance) of the sheet is stopped at an identical position. At that time, as shown in FIG. 3B, the sheet P1 is clamped in the nip between the second conveyance rollers 6 and projects from the nip a distance β that can be about several millimeters, for example, 5 mm.

Figure 3C:
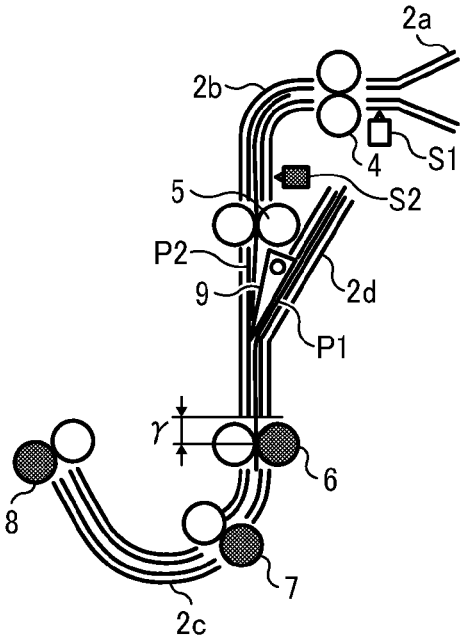

Subsequently, as shown in FIG. 3C, a second sheet P2 is transported by the first conveyance rollers 5. According to detection by the sheet detector S2, when the leading end of the second sheet P2 is at a predetermined distance, for example, 20 mm upstream from the second conveyance rollers 6, the second and third conveyance rollers 6 and 7 rotate counter-clockwise in FIG. 3C, thus starting conveyance of the sheet P1 retained in the second lower path 2*c* and the preliminary stacking channel 2*d*.

Figure 3D:
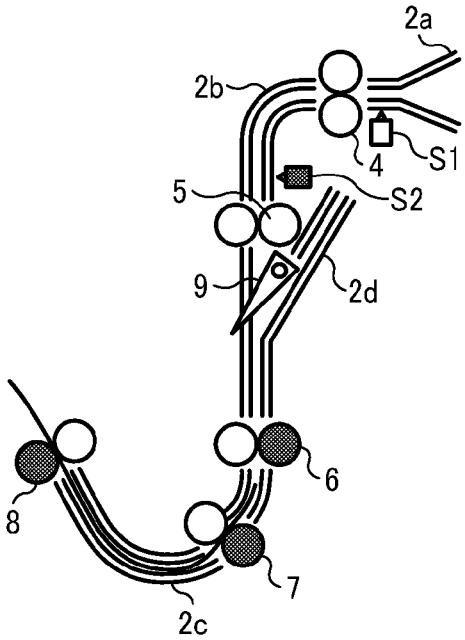

Referring to FIG. 3D, the first sheet P1 is transported again while being clamped in the nip between the third conveyance rollers 7. Accordingly, the sheets P1 and P2 are discharged together onto the stapling tray 14 with the leading end of the first sheet P1 downstream from the leading end of the second sheet P2. Subsequently, the projections 13*a* and 13*b*, which are provided symmetrically relative to the release belt 13, move in the direction indicated by arrow B shown in FIG. 1, and the projecting end portion of the sheet P1 is pushed by a back of one of the projections 13*a* and 13*b*. Then, the trailing-end fence 11 aligns the two sheets in the sheet conveyance direction. With this operation, post-processing of sheets can be performed without reducing the productivity of the image forming apparatus 1 or degrading the image quality. It is to be noted that the release belt 13 is disposed in a center portion of the stapling tray 14.

The description above concerns a case in which two sheets are conveyed together. That is, the number of sheets preliminary stacked ((hereinafter "preliminary stacked sheets") in the preliminary stacking channel 2*d* (hereinafter "preliminary stacking number or pre-stacking number") is one. Depending on the type of processing performed on the stapling tray 14, the above-described operation is repeated to stack more sheets one on top of another, thereby delaying the discharge timing of the subsequent set of sheets to the stapling tray 14 to secure the post-processing time of the previous set of sheets on the stapling tray 14.

Thus, preliminary stacking or preliminary stacking operation means stacking (buffering) the sheets received by the sheet processing apparatus 2 from the image forming apparatus 1 preliminary and temporarily upstream from the processing unit 18 or the stapling tray 14. Preliminary stacking is aimed at reducing loss in productivity caused by post-processing of sheets. Depending on the post-processing time or the number of sheets stacked preliminary, the productivity of the image forming apparatus 1 may decrease a certain degree even if preliminary stacking is performed. However, productivity loss can be reduced by preliminary stacking.

In view of the foregoing, the present embodiment is aimed at inhibiting productivity loss in cases in which productivity of the image forming apparatus 1 may decrease a certain degree even if preliminary stacking is performed.

Figure 4:
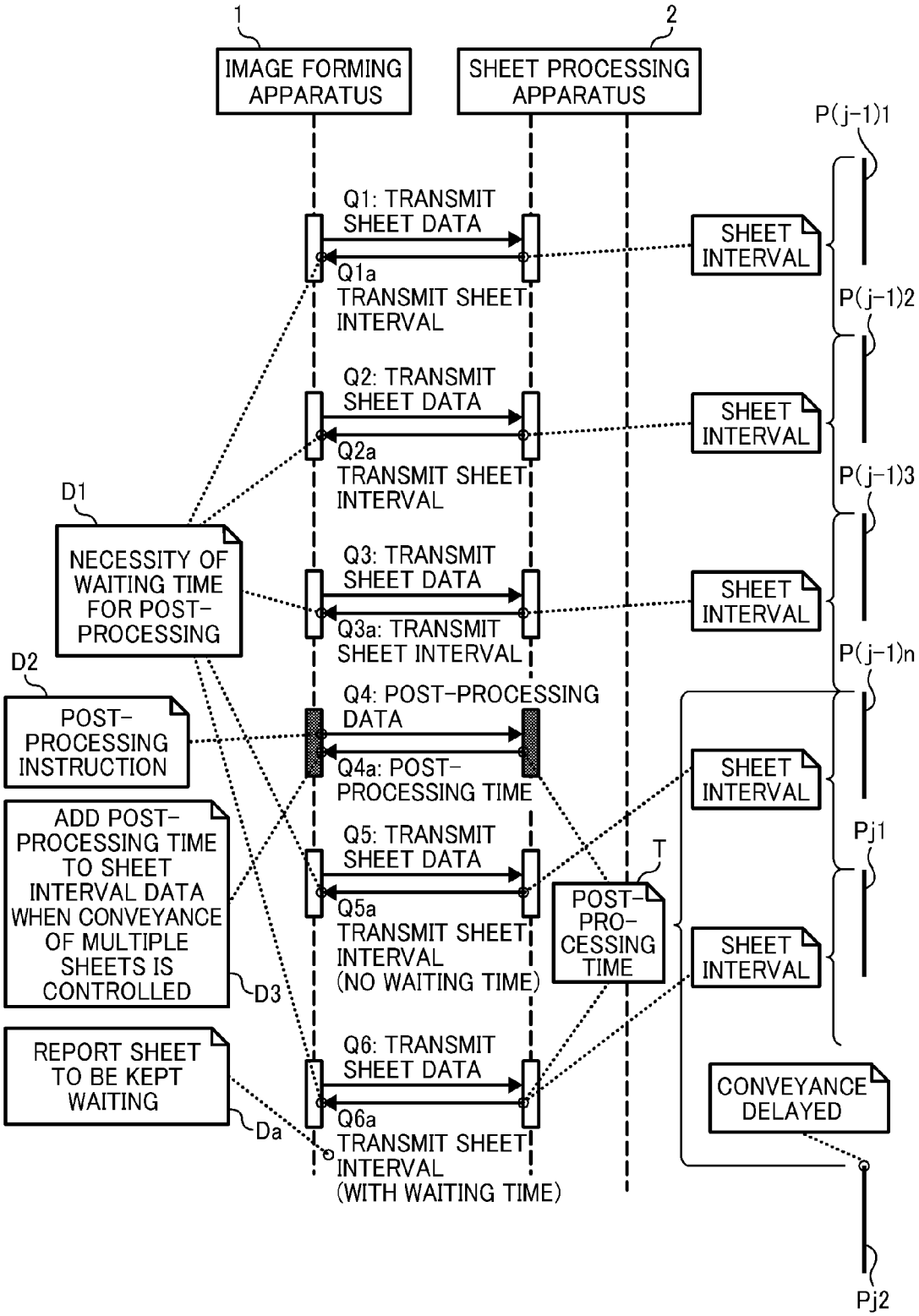
FIG. 4 is a diagram illustrating a control sequence for controlling signal transmission between the image forming apparatus and the sheet processing apparatus and sheet discharge intervals.

FIG. 4 is a diagram illustrating a control sequence for controlling signal transmission between the image forming apparatus 1 and the sheet processing apparatus 2 and sheet discharge intervals. It is to be noted that reference character Pj1 means a first sheet in a jth job ("j" represents the ordinal number of the job), and Pj2 means a second sheet in the that job.

Figure 6:
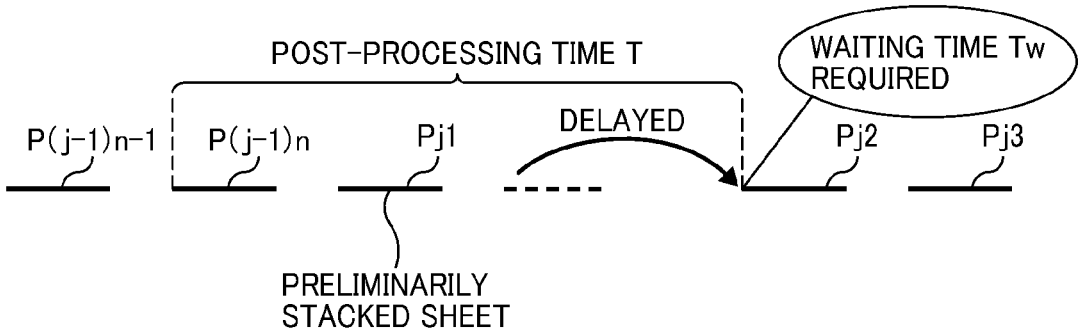
FIG. 6 illustrates control of sheet discharge intervals in a case in which the number of preliminary stacked sheets is one.

As described above, the image forming apparatus 1 and the sheet processing apparatus 2 communicate with each other via the communication interface 30. It is to be noted that, in the case shown in FIG. 4, the number of sheets, for example, sheets P(j-1)*l* to P(j-1)*n*, processed in a single job is "n" that is an integer not less than four. Although four or greater sheets are processed in one job in the case shown in FIG. 4, "n" is typically an integer equal to 2 or greater as shown in FIG. 6.

Referring to FIG. 4, sheet data is transmitted from the image forming apparatus 1 to the sheet processing apparatus 2 for each sheet at sequences Q1, Q2, Q3, Q5, and Q6. The sheet data can include sheet size, sheet type, and destination of discharge. According to destination of discharge, whether or not post processing is performed is known. Additionally, sheet interval data that in this case is a time period obtained by dividing a distance from a leading end of an interval start sheet (first sheet or preceding sheet) to a leading end of an interval end sheet (second sheet or interval adjustment sheet), which is not necessarily immediately after the interval start sheet, by a conveyance velocity is transmitted from the sheet processing apparatus 2 to the image forming apparatus 1 for each sheet at sequences Q1*a*, Q2*a*, Q3*a*, Q5*a*, and Q6*a*. To the sheet interval data transmitted at sequences Q1*a* to Q6*a*, information indicating whether waiting time Tw for post-processing is necessary (necessity of waiting time) is added (D1) by the sheet processing apparatus 2.

The image forming apparatus 1 transmits post-processing data or post-processing instructions indicating whether post-processing, such as stapling, is to be performed and post-processing type to the sheet processing apparatus 2 at a timing corresponding to the number of sheets processed (D2). In the case shown in FIG. 4, the image forming apparatus 1 transmits the post-processing instructions to the sheet processing apparatus 2 when the last sheet in a set, for example, the sheet P(j-1)*n*, is transported (sequence Q4).

In response to the post-processing instructions, the sheet processing apparatus 2 calculates time period necessary for the designated post-processing (post-processing time T) of the preceding job (j-1) and transmits it to the image forming apparatus 1 (sequence Q4*a*). When multiple sheets are involved in discharge interval adjustment for securing post-processing time T (stapling time in this example), the post-processing time T is transmitted.

In the case shown in FIG. 4, an interval time from discharge of the last sheet P(j-1)*n* of the preceding job to discharge of several sheets thereafter should be equal to or greater than the post-processing time T. Information indicating whether delay of discharge is necessary is added to the sheet interval data transmission command regarding the second sheet Pj2 (D3) because it cannot be decided at sequence Q4 which of the sheets is assigned to be kept waiting. In this state, discharge interval adjustment for post-processing is necessary, and discharge of the second sheet Pj2 from the image forming apparatus 1 is delayed.

Subsequent to sequence Q4, the image forming apparatus 1 transmits sheet data of the first sheet Pj1 of the subsequent job at sequence Q5. Based on the received sheet data, the sheet processing apparatus 2 transmits to the image forming apparatus 1 the sheet interval data indicating the period from the leading end of the last sheet P(j-1)*n* of the preceding job to the leading end of the first sheet Pj1 of the job at sequence Q5*a*. At this time, delay (waiting time for post-processing) in conveyance of the sheet Pj1 is not necessary. Subsequently, the image forming apparatus 1 transmits sheet data of the second sheet Pj2 (sequence Q6). Based on the received sheet data, the sheet processing apparatus 2 transmits to the image forming apparatus 1 the sheet interval data indicating the period from the leading end of the last sheet P(j-1)*n* of the preceding job to the leading end of the second sheet Pj2 of the subsequent job.

At that time, since the post-processing time T to be secured after discharge of the last sheet P(j-1)*n* of the preceding job before discharge of the Xth sheet has been transmitted from the sheet processing apparatus 2 to the image forming apparatus 1, the sheet to be kept waiting (also "interval end sheet") is identified and reported (D4). In the case shown in FIG. 4, the second sheet Pj2 is assigned to interval adjustment, and discharge thereof from the image forming apparatus 1 is delayed for post-processing.

After elapse of the waiting time, the second sheet Pj2 is not sent to the preliminary stacking channel 2*d* but is conveyed to the lower path 2*c* and superposed on the sheet Pj1 that is partly retained in the preliminary stacking channel 2*d* as shown in FIGS. 3B to 3D. Then, the sheets Pj1 and Pj2 are transported together. In this case, only the second sheet Pj2 is kept waiting regardless of whether it is the last sheet Pjn in that job or not.

Figure 5:
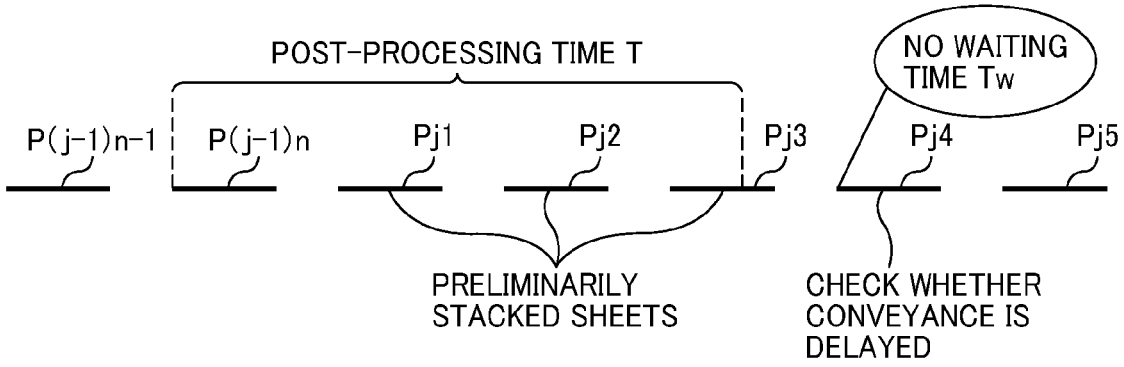
FIG. 5 illustrates control of sheet discharge intervals in a case in which the number of preliminary stacked sheets is three.

Referring to FIGS. 5 and 6, timing at which the interval end sheet is transported from the image forming apparatus 1 to the sheet processing apparatus 2 is described below.

The sheet that has been retained in the preliminary stacking channel 2*d* and the sheet subsequent thereto (hereinafter also "sheet subsequent to pre-stacking"), stacked on top of and the preliminary stacked sheets, are transported together to the stapling tray 14. Accordingly, what discharged to the stapling tray 14 after the last sheet P(j-1)*n* of the preceding job is discharged to the stapling tray 14 is a sum of the preliminary stacked sheet(s) plus one (sheet subsequent to pre-stacking) of the subsequent job (j). Therefore, when a time period from the last sheet P(j-1)*n* of the preceding job to the sheet subsequent to pre-stacking of the subsequent job (j) is longer than a specified time (necessary for post-processing of the preceding job), the sheets of the subsequent job (j) can be prevented from entering the stapling tray 14 during processing of the preceding job (j-1). Thus, conveyance timing of the sheet subsequent to pre-stacking may be adjusted for post-processing as required.

FIG. 5 illustrates sheet conveyance control in a case in which the number of preliminary stacked sheets (preliminary stacking number) is three.

In the case shown in FIG. 5, the fourth sheet Pj4 subsequent to pre-stacking is transported together with the preliminary stacked sheets Pj1 to Pj3. The time period from the last sheet P(j-1)*n* of the preceding job to the sheet subsequent to pre-stacking Pj4 of the subsequent job is compared with the post-processing time T. When this period is greater than the post-processing time T as shown in FIG. 5, it is not necessary to change timing of image formation or conveyance of sheets to the sheet processing apparatus 2, or both (no waiting time Tw). In this control, the sheets can be processed in the sheet processing apparatus 2 without impairing productivity of the image forming apparatus 1.

Needless to say, in the case in which the preliminary stacking number is three, if the sheet interval time from the last sheet P(j-1)*n* to the sheet subsequent to pre-stacking (fourth sheet Pj4) is shorter than the post-processing time T, conveyance of the sheet subsequent to pre-stacking to the sheet processing apparatus 2 is delayed, that is, waiting time Tw is required.

FIG. 6 illustrates sheet conveyance control in a case in which the number of preliminary stacked sheets is one.

In the case shown in FIG. 6, the sheet interval time from the last sheet P(j-1)*n* in the preceding job to the sheet Pj2 subsequent to pre-stacking of the subsequent job is shorter than the post-processing time T. Therefore, the timing at which the image forming apparatus 1 sends out the sheet Pj2 is delayed to make the sheet interval time from the sheet P(j-1)*n* to the sheet Pj2 equal to or longer than the post-processing time T. That is, waiting time Tw is required. It is advantageous for productivity that the delay time (waiting time Tw) is set such that the sheet interval time from the sheet P(j-1)*n* to the sheet Pj2 subsequent to pre-stacking is equal to the post-processing time T.

Figure 7:
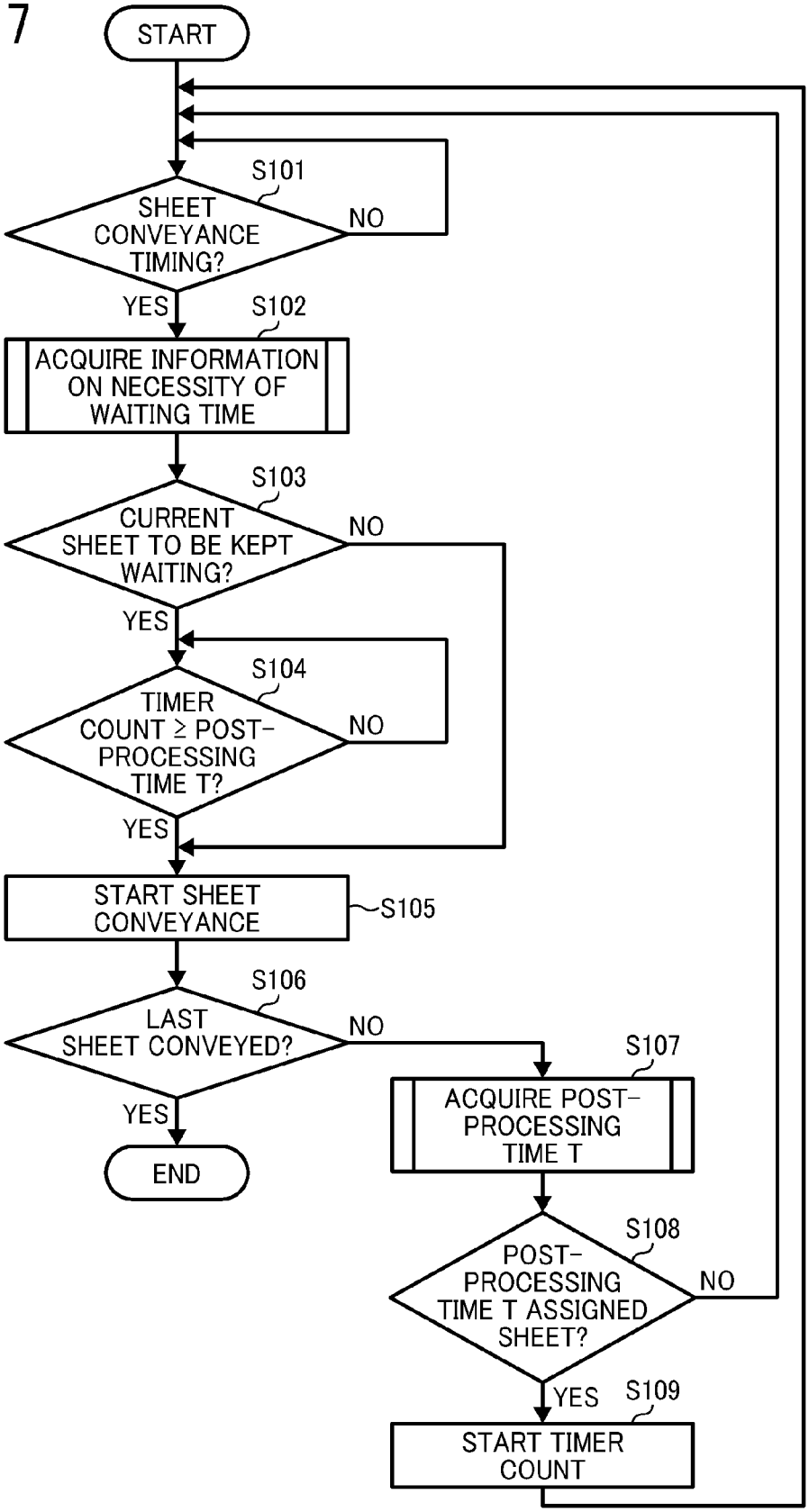
FIG. 7 is a flowchart of sheet conveyance control by the image forming apparatus according to an embodiment.

FIG. 7 is a flowchart of control according to the present embodiment executed by the CPU 1*a* of the image forming apparatus 1 for sheet conveyance in the image forming apparatus 1.

Referring to FIGS. 4 and 7, at S101 the CPU 1*a* checks whether it is time to transport a current sheet. When it is time to transport the current sheet (Yes at S101), at S102 the CPU 1*a* obtains information indicating whether delay in conveyance (waiting time Tw) is necessary and determines whether the current sheet is designated as the interval end sheet at S103. In the sequence shown in FIG. 4, at sequence Q6*a*, the second sheet Pj2 is reported as the interval end sheet to be kept waiting.

When the current sheet is designated as the interval end sheet (Yes at S103), at S104 the CPU 1*a* checks whether a timer count is equal to or greater than the post-processing time T. When the timer count reaches the post-processing time T (Yes at S104), at S105 conveyance of the current sheet is started. At S106, the CPU 1*a* checks whether that is the last sheet discharged from the image forming apparatus 1. When it is the last sheet (Yes at S106), the process is completed.

When it is not the last sheet (No at S106), at S107 the CPU 1*a* obtains the post-processing time T transmitted from the CPU 32 of the sheet processing apparatus 2. At S108, the CPU 1*a* checks whether the post-processing time T is reported or assigned to that sheet. In the sequence shown in FIG. 4, the post-processing time T is transmitted at sequence Q4*a*, and the post-processing time T is assigned to the sheet P(j-1)*n*. When the post-processing time T is not assigned to that sheet (No at S108), the process returns to the step S101, and the CPU 1*a* waits for the timing for transporting the sheet. Then, steps S102 and thereafter are repeated.

When the post-processing time T is assigned to that sheet (Yes at S108), at S109 timer counting for interval adjustment for post-processing is started. Then, steps S101 and after are repeated.

Figure 11:
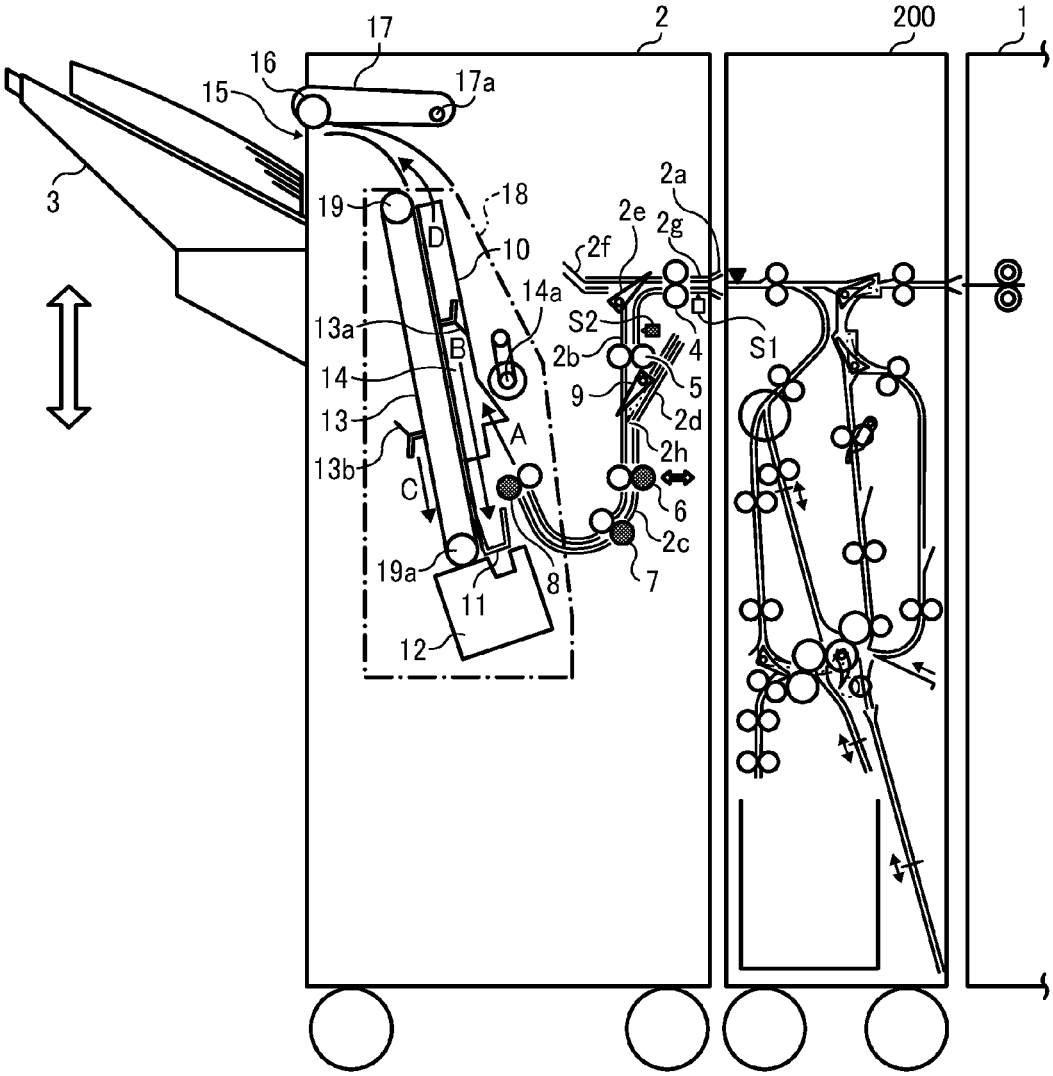
FIG. 11 illustrates a configuration of an image forming system that includes a sheet folding device.

Herein, in the sheet processing apparatus 2, the number of sheets preliminary stacked in the preliminary stacking channel 2*d* can be changed depending on post-processing type or sheet data (such as sheet size, sheet type, and like), or both. For example, two-position stapling typically involves moving the stapler from a first position to a second position, and accordingly the processing time increases. In the case of processing that requires a longer time, loss in productivity can be minimized by increasing the number of sheets stacked preliminary. It is to be noted that, post-processing type may include processing performed by another sheet processing device, such as a sheet folding device 200 shown in FIG. 11, provided upstream from the sheet processing apparatus 2.

By contrast, time required for single-position stapling is shorter than that for two-position stapling, and accordingly the number of sheets stacked preliminary can be smaller. Additionally, in the case of long sheets, an interval saved by preliminary stacking a single sheet is longer. Accordingly, loss in productivity can be restricted even if the number of sheets stacked preliminary is smaller. By contrast, in the case of short sheets, the productivity can decrease significantly unless a greater number of sheets are stacked preliminary. Meanwhile, stacking a smaller number of sheets preliminary is advantageous in alignment of sheets in the sheet processing apparatus 2. Therefore, changing the number of preliminary stacked sheets is preferred to balance the productivity and alignment performance.

Additionally, a maximum number of sheets stacked preliminary (hereinafter "maximum pre-stacking number") in the preliminary stacking channel 2*d* can be selected via the control panel 1*b*. The maximum pre-stacking number thus selected can be stored in a memory unit, and the control circuit of the image forming system can determine the number of preliminary stacked sheets according to the designated processing with reference to the stored maximum pre-stacking number. In an initial setting, the maximum pre-stacking number is determined by hardware performance, capacity, or the like. However, it is difficult to design the preliminary stacking channel 2*d* for good performance in conveyance of heavy paper sheets or special purpose sheets due to limitations on cost and space. If there is the possibility of jamming of sheets or damage to sheets, it is preferred to reduce the pre-stacking number or eliminate preliminary stacking (pre-stacking number is zero). Therefore, separately from the maximum number determined by hardware factors, the image forming apparatus 1 according to the present embodiment is configured such that the user can set the maximum pre-stacking number (smaller than the maximum number determined by hardware factors) by software using the control panel 1*b*, thereby improving the conveyance performance.

It is to be noted that, when the pre-stacking number is zero, a sheet immediately subsequent to the preceding sheet is designated as the interval end sheet (interval adjustment sheet), and the sheet interval time between them is made equal to or longer than the post-processing time T.

Thus, even when the pre-stacking number is changed, loss in productivity can be minimized by controlling the timing of discharge of the sheet from the image forming apparatus 1 or sheet feeding in the image forming apparatus 1 such that the time period from the last sheet P(j-1)*n* in the preceding job to the sheet subsequent to pre-stacking in the subsequent job (j) is equal to or longer than the post-processing time T.

In other words, the sheet conveyance control according to the present embodiment includes reporting (designating) the interval end sheet, discharge timing of which is adjusted for securing post-processing time, at sequence Q6*a* (in FIG. 4) in accordance with changes in the pre-stacking number, separately from transmission of post-processing time T at sequence Q4*a*. The interval end sheet is the fourth sheet Pj4 in the case shown in FIG. 5 and the second sheet Pj2 in the case shown in FIG. 6.

Depending on post-processing type, sheet size, sheet type, or the like, the sheet designated as the interval end sheet varies, and accordingly the timing at which interval end sheet is reported varies. For example, the sheet subsequent to pre-stacking can be deemed the interval end sheet, and discharge timing thereof is adjusted for post-processing time T.

Descriptions are given below of discharge timing of the last sheet Pn in the subsequent job from the image forming apparatus 1 when the number of sheets in a single bundle is smaller than the maximum pre-stacking number.

When the number of sheets in an identical bundle processed together, for example, one set of sheets stapled together, is smaller than the maximum pre-stacking number, the first sheet Pj1 through the second sheet Pj(n-1) from the last are assigned to preliminary stacking, and the last sheet Pjn is designated as the sheet subsequent to pre-stacking. Accordingly, what transported to the stapling tray 14 after the last sheet P(j-1)*n* of the preceding job is discharged to the stapling tray 14 includes the preliminary stacked sheets Pj1 through Pj(n-1) and the last sheet Pjn.

Therefore, when the sheet interval time from the last sheet P(j-1)*n* of the preceding job to the last sheet Pjn of the subsequent job is equal to or longer than the specified time (post-processing time T), the sheets of the subsequent job (j) do not enter the stapling tray 14 during processing of the preceding job (j-1).

Figure 8:
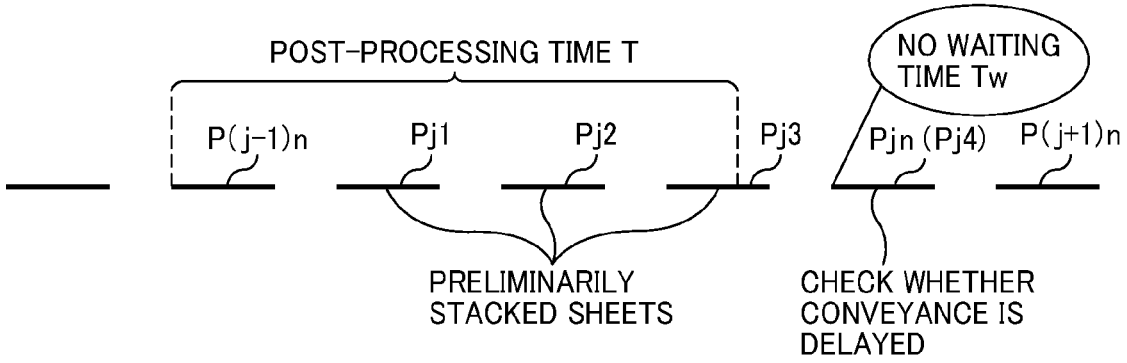
FIG. 8 illustrates conveyance timing of a last sheet (fourth sheet) in a subsequent bundle including four sheets.

FIG. 8 illustrates a case in which the number of sheets in the subsequent job (j) is four.

As shown in FIG. 8, when the sheet interval time from the last sheet P(j-1)*n* of the preceding job to the last sheet Pjn of the subsequent job equals or is greater than the post-processing time T, it is not necessary for the image forming apparatus 1 to delay timing of image formation or conveyance of sheets to the sheet processing apparatus 2, or both. Thus, post-processing of sheets can be performed without degrading the productivity of the image forming apparatus 1.

Figure 9:
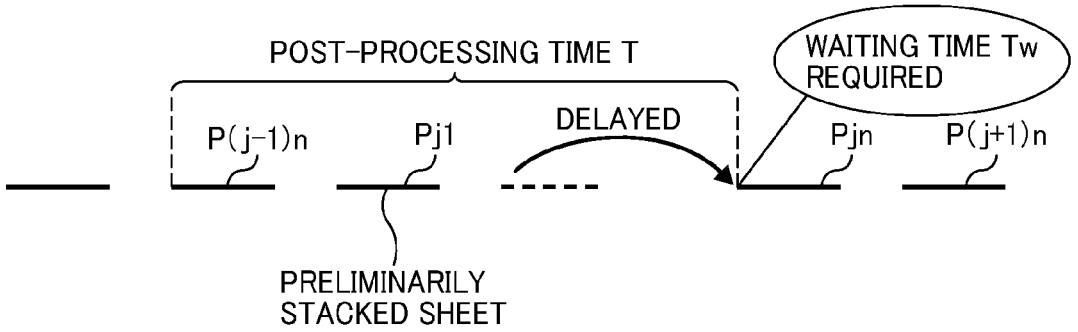
FIG. 9 illustrates conveyance timing of a last sheet (second sheet) in a subsequent bundle including two sheets.

FIG. 9 illustrates a case in which the number of sheets in the subsequent job (j) is two.

As shown in FIG. 9, when the sheet interval time from the last sheet P(j-1)*n* in the preceding job to the last sheet Pj2 (Pjn) in the subsequent job before adjustment is shorter than the post-processing time T, the timing at which the last sheet Pj2 is sent out is delayed to make the sheet interval time equal to or longer than the post-processing time T. It is advantageous for productivity that the delay time (waiting time) is set such that the sheet interval time from the sheet P(j-1)*n* to the last sheet Pjn is equal to the post-processing time T.

In this case, the last sheet Pjn in the subsequent job is designated as the interval adjustment sheet for post-processing time.

For the cases shown in FIGS. 8 and 9, the sequence for controlling sheet conveyance by the image forming apparatus 1 is similar to that shown in FIG. 7.

It is to be noted that the above-described specified time (target interval time for post-processing time T) is determined in accordance with at least one of post-processing type, sheet type, sheet size, and the like. For the cases shown in FIGS. 8 and 9, the specified time specifies the time period from arrival of the last sheet P(j-1)*n* of the preceding bundle at the stapling tray 14 until the last sheet Pjn of the subsequent bundle enters the stapling tray 14 and substantially the same as the time required for post-processing. That is, this time period depends on post-processing type.

However, movements of respective components can vary depending on sheet size, sheet type, or the like. For example, it may be necessary to increase the number of times of alignment action in the case of larger sheet size compared with smaller sheet size. Thus, the post-processing time T varies depending on sheet size, and the specified time changes accordingly.

Determining the specified time in accordance with post-processing type can obviate the necessity for complicated calculation based on various factors. Similarly, determining the specified time in accordance with sheet size can obviate the necessity for complicated calculation based on various factors. Therefore, determining the specified time in accordance with post-processing type and sheet size can minimize the loss in productivity with simple control.

Figure 10:
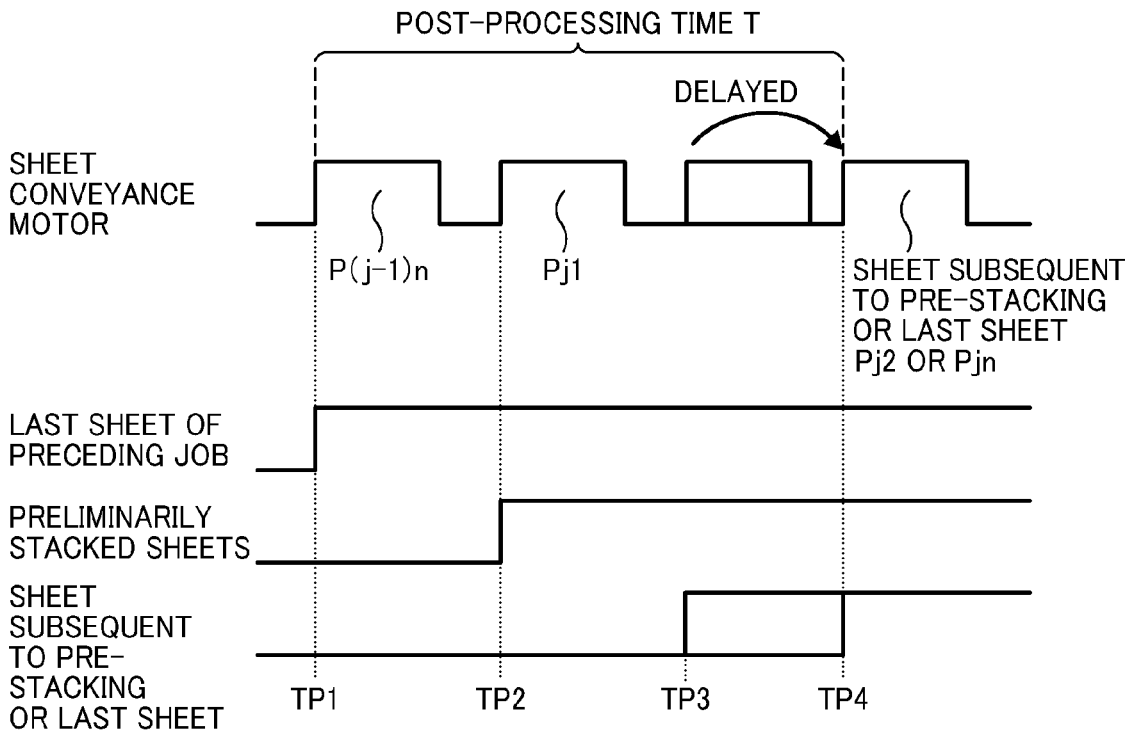
FIG. 10 is a timing chart illustrating sheet conveyance timing for the case shown in FIG. 9.

FIG. 10 is a timing chart illustrating sheet conveyance timing of the image forming apparatus 1 for the case shown in FIG. 9.

The above-described specified time (target interval time for post-processing time T) can be secured by delaying driving timing of the motor for sheet conveyance in the image forming apparatus 1. In the case shown in FIG. 9, in which only a single sheet (sheet Pj1) is preliminary stacked, after the first sheet Pj 1 is conveyed, the second sheet Pj2 (sheet subsequent to pre-stacking or last sheet) is transported after elapse of the specified time from when conveyance of the last sheet P(j-1)*n* of the preceding job is started. With this control, in the case in which the pre-stacking number is one, the sheet Pj2 (last sheet of that job) subsequent to pre-stacking is not transported to the preliminary stacking channel 2*d* before transported to the stapling tray 14.

Other than the differences described above, the conveyance control shown in FIG. 10 is similar to that described with reference to FIGS. 5 and 6.

FIG. 11 illustrates a configuration of an image forming system that includes a sheet folding device.

In the configuration shown in FIG. 11, a sheet folding device 200 is provided upstream from the sheet processing apparatus 2 in the sheet conveyance direction. The sheet folding device 200 is capable of folding sheets in various manners such as folding in two, folding into Z-shape, folding in three inward, or folding in four.

In the image forming system shown in FIG. 11, a single sheet processing job can includes a folded sheet, for example, a sheet folded into Z-shape. The configuration shown in FIG. 11 is not designed so that the folded sheet and the preceding sheet are discharged together from the preliminary stacking channel 2*d* to the stapling tray 14.

Accordingly, in such cases, the folded sheet and the sheet preceding the folded sheet are not stacked preliminary. Therefore, conveyance of the sheet preceding the folded sheet is delayed when the timing at which the folded sheet is conveyed falls within the post-processing time T, in which the sheet is to be stacked preliminary if the sheet is not the folded.

In this case, that sheet is designated to be kept waiting for interval adjustment at sequence Q6*a* shown in FIG. 4, and conveyance of that sheet is delayed to secure the post-processing time T transmitted at sequence Q4*a*.

Similarly, special shape sheets, such as those for used of index tab, are not retained in the preliminary stacking channel 2*d*. When the timing at which the special shape sheet is conveyed falls within the post-processing time T, in which the sheet is to be stacked preliminary if the sheet is a standard sheet, the special shape sheet is designated as the interval end sheet (interval adjustment sheet), and conveyance of that sheet is delayed. It is to be noted that designation of the interval end sheet can be reported to the CPU 1*a* of the image forming apparatus 1 that sends out the sheet or a CPU of a sheet feeder that feeds the special shape sheet.

As described above, the present embodiment can attain the following effects.

The image forming apparatus 1 transmits at least one of sheet data and post-processing data to the sheet processing apparatus 2 (sequences Q1, Q2, Q3, Q5, and Q6) and receives post-processing time T (target interval time) calculated based on the transmitted data (sequence Q4*a*). Based on the post-processing time T, the CPU 1*a* controls sheet interval time between two sheets, the interval start sheet and the interval end sheet, which is not necessarily immediately subsequent to the interval start sheet, discharged from the image forming apparatus 1 to the sheet processing apparatus 2. Accordingly, optimum productivity can be attained with control from image formation to post-processing kept relatively simple.

Since designation timing of the interval start sheet, which can be the last sheet P(j-1)*n* in the preceding job in FIGS. 4 to 6 and 8 to 10, and designation timing of the interval end sheet are different, the interval end sheet (with which the discharge interval to be adjusted) can be designated in view of the time necessary for post-processing of the preceding job (j-1).

The designation of the interval end sheet (interval adjustment sheet) and the number of preliminary stacked sheets can be changed in accordance with at least one of post-processing data and sheet data transmitted from the image forming apparatus 1. Thus, the interval end sheet can be designated according to the post-processing time T and the number of preliminary stacked sheets.

Since the image forming apparatus 1 includes the control panel 1*b* to set the maximum pre-stacking number, defective conveyance in the preliminary stacking channel 2*d* can be prevented.

When the pre-stacking number is zero, the interval end sheet is changed to the sheet immediately subsequent to the preceding sheet. That is, the interval time between two consecutive sheets is adjusted for securing post-processing time T. Thus, the interval end sheet can be designated in a simple method.

The last sheet P(j-1)*n* in a bundle of sheets stapled together and the last sheet P(j)n in the subsequent bundle are respectively assigned to the interval start sheet and the interval end sheet, an interval between which is adjusted for post-processing time T. In this case, retaining of sheets in the preliminary stacking channel 2*d* is performed once in a single job, that is, retaining operation corresponds to each job, and productivity can increase.

Since discharge timing of the interval end sheet can be determined in accordance with at least one of post-processing data and sheet data transmitted from the image forming apparatus 1, intervals at which sheets are discharged from the image forming apparatus 1 to the sheet processing apparatus 2 can be adjusted in accordance with at least one of post-processing data and sheet data.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming system comprising:

an image forming apparatus to form images on sheets of recording media;

a sheet processing apparatus including:

a post-processing unit to perform a predetermined post-processing of the sheets output from the image forming apparatus on a processing tray, and a retaining channel disposed upstream from the processing tray in a sheet conveyance direction to accommodate at least a single sheet while the post-processing unit processes the sheets; and a controller operatively connected to the image forming apparatus and the sheet processing apparatus, the controller being configured such that the controller:

calculates a target interval time between an interval start sheet and an interval end sheet among the sheets output from the image forming apparatus to the sheet processing apparatus based on at least one of sheet data transmitted from the image forming apparatus to the sheet processing apparatus and post-processing data transmitted from the image forming apparatus to the sheet processing apparatus; and adjusts an interval between discharge of the interval start sheet and the interval end sheet from the image forming apparatus to the sheet processing apparatus in accordance with the target interval time, stores at least the interval start sheet in the retaining channel while the processing tray is not available, wherein the interval end sheet by-passes the retaining channel.

2. The image forming system according to claim 1, wherein at least a single sheet is interposed between the interval start sheet and the interval end sheet.

3. The image forming system according to claim 2, wherein the controller delays a timing at which the interval end sheet is discharged from the image forming apparatus to secure the target interval time between the interval start sheet and discharge of the interval end sheet.

4. The image forming system according to claim 2, wherein the target interval time between the interval start sheet and the interval end sheet equals a time required for the post-processing unit to perform the predetermined post-processing of the sheets.

5. The image forming system according to claim 2, wherein a last sheet in a preceding bundle of sheets processed by the post-processing unit is designated as the interval start sheet, a subsequent bundle includes a pre-stacked sheet retained in the retaining channel and a sheet subsequent to the pre-stacked sheet discharged together with the pre-stacked sheet to the processing tray, and the sheet subsequent to the pre-stacked sheet is designated as the interval end sheet.

6. The image forming system according to claim 1, wherein the interval start sheet and the interval end sheet are designated at different timings.

7. The image forming system according to claim 6, wherein, in accordance with at least one of the sheet data and the post-processing data, the controller changes a quantity of pre-stacked sheets retained in the retaining channel and designation of the interval end sheet.

8. The image forming system according to claim 7, further comprising an input unit to set a maximum quantity of pre-stacked sheets retained in the retaining channel.

9. The image forming system according to claim 7, wherein, when the quantity of pre-stacked sheets in the retaining channel is zero, a sheet subsequent to the interval start sheet is designated as the interval end sheet.

10. The image forming system according to claim 7, wherein a last sheet in a preceding bundle of sheets processed by the post-processing unit is designated as the interval start sheet, a first sheet through a second sheet from the last of a subsequent bundle are retained in the retaining channel, and a last sheet in the subsequent bundle is designated as the interval end sheet.

11. The image forming system according to claim 1, wherein the sheet data transmitted from the image forming apparatus comprises sheet size and sheet type, and the controller calculates the target interval time between the interval start sheet and the interval end sheet based on at least one of the sheet size, the sheet type, and the post-processing data.

12. A sheet conveyance method used in an image forming system including an image forming apparatus and a sheet processing apparatus, the sheet processing apparatus including a post-processing unit to perform a predetermined post-processing of sheets on a processing tray, and a retaining channel disposed upstream from the processing tray, the sheet conveyance method comprising:

transmitting sheet data and post-processing data from the image forming apparatus to the sheet processing apparatus;

calculating a target interval time between an interval start sheet and an interval end sheet output from the image forming apparatus to the sheet processing apparatus based on at least one of the sheet data transmitted from the image forming apparatus to the sheet processing apparatus and the post-processing data transmitted from the image forming apparatus to the sheet processing apparatus;

adjusting an interval between discharge of the interval start sheet and the interval end sheet from the image forming apparatus to the sheet processing apparatus in accordance with the calculated target interval time; and storing at least the interval start sheet in the retaining channel while the processing tray is not available, wherein the interval end sheet by-passes the retaining channel.

13. The sheet conveyance method according to claim 12, wherein the interval start sheet and the interval end sheet are designated at different timings.

14. The sheet conveyance method according to claim 12, further comprising:

designating, as the interval start sheet, a last sheet in a preceding bundle of sheets processed on the processing tray;

designating at least a first sheet of a subsequent bundle as a pre-stacked sheet retained in the retaining channel;

designating, as the interval end sheet, a sheet subsequent to the pre-stacked sheet retained in the retaining channel; and discharging the pre-stacked sheet and the sheet subsequent thereto together to the processing tray.

* * * * *